United States Patent [19]

Schmidt et al.

[11] Patent Number: 4,612,047

[45] Date of Patent: Sep. 16, 1986

[54] PREPARATIONS OF RARE EARTH-IRON ALLOYS BY THERMITE REDUCTION

[75] Inventors: Frederick A. Schmidt; David T. Peterson, both of Ames; John T. Wheelock, Nevada, all of Iowa

[73] Assignee: The United States of America as represented by the United States Department of Energy, Washington, D.C.

[21] Appl. No.: 791,972

[22] Filed: Oct. 28, 1985

[51] Int. Cl.[4] ..... C22C 33/00

[52] U.S. Cl. ..... 420/83; 75/27; 148/302; 148/301

[58] Field of Search ..... 75/133.5, 27, 130 R

[56] References Cited

U.S. PATENT DOCUMENTS 3,415,642 12/1968 Matsumoto ..... 75/130 R

*Primary Examiner*—Peter D. Rosenberg

*Attorney, Agent, or Firm*—James W. Weinberger; Arthur A. Churm; Judson R. Hightower

[57] ABSTRACT

An improved method for the preparation of high-purity rare earth-iron alloys by the aluminothermic reduction of a mixture of rare earth and iron fluorides.

13 Claims, No Drawings

PREPARATIONS OF RARE EARTH-IRON ALLOYS BY THERMITE REDUCTION

The U.S. Government has rights in this invention pursuant to Contract No. W-7405-ENG-82 between the U.S. Department of Energy and Iowa State University.

BACKGROUND OF THE INVENTION

This invention relates to a method of preparing rare earth-iron alloys. More specifically, this invention relates to an improved method of preparing high-purity rare earth-iron binary and ternary alloys by the thermite reduction method.

A number of rare earth-iron alloys have been developed which have interesting physical properties. For example, rare earth-iron alloys having magnetostrictive properties were described by Savage et al. in U.S. Pat. No. 4,308,474 which issued Dec. 29, 1981. The materials described therein were found to be particularly useful in magnetostrictive transducers, delay lines, variable frequency resonators and filters.

Another series of alloys based on the combination of rare earth, iron and boron were described in Materials Letters, Vol. 2, Number 2, October 1983, page 169 et seq. and in the J. Appl. Phys. 55(6), Mar. 15, 1984, page 2078 et seq. Nd-Fe-B and Pr-Fe-B alloys were described which show great promise as permanent magnet materials.

These alloys are expensive because of the cost of purifying the starting materials and the number of steps required to prepare these materials. Typically, the alloy is prepared by melting together the several purified metals which will constitute the alloy. The difficulty, however, arises in the preparation of high-purity rare earth metals. For example, a terbium-dysprosium-iron alloy may be prepared by first fluorinating terbium oxide with hydrogen fluoride to form terbium fluoride ($TbF_3$). The terbium fluoride is then reduced with calcium metal to form an impure terbium metal. This terbium is then purified by heating to 1600° to 1700° C. to sublime the metal away from the impurities, condensing it on a cold head. The sublimed metal is then arc melted to form a bar. Using the same series of steps, high purity dysprosium metal is separately prepared and formed into a bar. Only at this time can appropriate quantitites of the purified terbium metal, dysprosium metal and purified iron be arc melted together to form the terbium-dysprosium-iron alloy.

As the example illustrates, the preparation of an alloy is time consuming and requires a substantial amount of energy, both of which go to increase the cost of preparing such rare earth-iron alloys.

Furthermore, it should be noted that in preparing pure un-alloyed rare earth metals using metallothermic methods, extreme care must always be taken to insure that oxygen, nitrogen, and carbon contamination does not occur during processing. The rare earth metal has a high affinity for these impurities and they can greatly effect the properties of the rare earth metals.

An improved method for the preparation of high-purity rare earth-iron alloys has been developed by which the alloys can quickly and economically be prepared by thermite reduction of rare earth and iron fluorides.

SUMMARY OF THE INVENTION

According to the method of the invention for the preparation of high-purity rare earth-iron alloys, at least one rare earth fluoride is mixed with iron fluoride to form a mixture, adding calcium metal to this mixture to form a reaction mixture, the amount of calcium being a stoichiometric amount necessary to completely reduce the fluorides to the metal, heating the reaction mixture under reducing conditions to a temperature sufficient to react the fluorides in the mixture with the calcium metal to form a metal alloy and a calcium fluoride slag, and separating the alloy from the slag, thereby forming the rare earth-iron alloy.

The method of the invention is suitable for the preparation of rare earth-iron alloys which may contain one or more rare earths and which may also contain one or more additional alloying metals such as boron. The method is especially suitable for the preparation of rare earth-iron alloys such as the terbium-dysprosium-iron alloys having magnetostrictive properties and for the preparation of the praseodymium or neodymium-iron alloys containg boron which are suitable for the preparation of permanent magnets.

Further, it has been found that contaminents such as oxygen, nitrogen and carbon are much less soluble in the rare earth-iron alloy than in the unalloyed rare earth metal and that high quality alloys may be prepared from reactant materials that are of lesser quality and consequently that have a lower cost. Mixtures of rare earths, which naturally occur together, may be utilized without the necessity of complete separation. For example, terbium and dysprosium oxides which elute from an ion exchange column sequentially, may be fluorinated and reduced together by the method of the invention, with adjustment to the alloy composition made later as explained hereinafter.

It is therefore one object of the invention to provide an improved method for the preparation of rare earth-iron alloys.

It is a further object of the invention to provide an improved method for preparing high-purity rare earth-iron alloys which is less expensive than the present methods of preparing these alloys.

Finally, it is the object of the invention to provide an improved method for preparing high-purity rare earth-iron alloys which utilizes the thermite method of reduction.

DETAILED DESCRIPTION OF THE INVENTION

These and other objects of the invention may be met by mixing one or more rare earth fluorides, as finely divided particles, with a finely divided iron fluoride, which may be either ferrous or ferric fluoride or a mixture thereof, to form a mixture adding finely divided calcium metal, to the mixture to form a reaction mixture, the amount of calcium being about a 10% excess of a stoichiometric amount necessary to completely reduce the fluoride to the metal, heating the reaction mixture in a thick-walled iron container, under reducing conditions, to a temperature sufficient to react the rare earth and iron fluoride mixture with the calcium to form the metal alloy and calcium fluoride slag, the container having sufficient heat capacity to dissipate the heat of reaction, and separating the alloy from the slag, thereby forming the rare earth-iron alloy.

The rare earth-iron base alloys that result from the reduction step can be cast into a water-cooled copper mold by arc melting or in a suitable refractory crucible by induction melting. During the casting step, residual calcium fluoride slag and calcium metal is removed from the rare earth-iron alloys by gravity separation or vaporization. Any discrepancies in alloy composition can be corrected at the time by adding additional quantities of the appropriate metal to the molten alloy.

The reaction mixture must contain sufficient iron fluoride to raise the temperature of the mixture, during the reduction reaction to at least 1600° C. in order that the reduction will go to completion, to consolidate the reduced metal into the alloy, and to complete the separation of the alloy from the slag. As the quantity of the reaction mixture is increased, less iron fluoride is needed in the mixture to provide heat for the reaction. Elemental iron in the form of iron turnings or granules may be substituted for some of the iron fluoride. Reduction in the amount of iron fluoride will also permit reduction in the amount of calcium metal necessary to reduce the mixture, lowering the cost of the process.

The amount of calcium metal necessary for the reduction mixture is the stoichiometric amount necessary to reduce the amount of fluoride present. Preferably up to about 10% excess calcium metal is added to the mixture to ensure that the reduction reaction goes to completion.

Preferably, the fluorides are dried to remove any excess moisture which may adversely affect the reduction reaction.

The particle size is not critical but must be small enought to form an intimate mixture to ensure a complete reaction. A fluoride mesh size of −150 together with calcium metal size of up to ¼" in diameter gave satisfactory results.

The reduction is of the thermite-type which preferably takes place in a sealed container such as a sealed metal crucible lined with a refractory material, in a water-cooled copper reduction bomb or preferably in a thick-walled iron crucible which can be sealed to contain the reaction. The iron crucible is preferred because iron is not a containment in an iron alloy and because iron has a large heat capacity. The iron crucible must have sufficient heat capacity to dissipate the exothermic heat generated by the reaction.

The reaction can be initiated by heating the container to ignition temperature in a furnace or the reaction may be initiated by internal heating, using a resistively heated iron filement, with or without a "trigger" mixture consisting of a small amount of calcium metal and iron fluoride. The use of such a trigger is well known to those skilled in the art.

The method of the invention can be used to prepare binary, ternary, or other multi-component rare earth-iron alloys from any of the lanthanide rare earths including scandium and yttrium by providing the correct ratio of starting materials in the reduction mixture. Discrepancies in the ratio of metals in the alloy may be corrected by the addition of appropriate quantities of metals to the alloy. Other metals such as boron may be added to the mixture as long as they will alloy with both the lanthanides and iron.

The method may be used to prepare RE-Fe-B alloys having magnetic properties where RE=neodynium, dysprosium, erbium, praseodymium or samarium. Similarily, the method is useful for preparing magnetostrictive alloys of the RE-Fe type where RE one or more of terbium, dysprosium, holmium and samarium.

The following Examples are given to illustrate the invention, but are not to be taken as limiting the scope of the invention which is defined by the appended claims.

EXAMPLE I

A mixture of 122 g $DyF_3$ and 122.3 g $FeF_3$ blended with 103 g of granular calcium metal which corresponds to the stoichiometric amount for reduction plus 5% excess of calcium. The fluorides were dried of residual moisture prior to use. The charge was loaded inside a 10 cm diameter steel crucible containing a jolt-packed liner of $CaF_2$. A "trigger" mixture consisting of 10 g of $FeF_3$ and 10 g of calcium was placed on top of the charge. A coiled iron filament was embedded into the trigger mixture and one end attached to the metal crucible and the other end to an automotive spark plug which was threaded through the wall of the crucible and served as an electrical feedthough. Calcium fluoride was then added to fill the crucible. A flange with an "O" ring seal was attached to the crucible and a thermocouple attached to the side of the crucible. The reaction was initiated by resistively heating the iron filament embedded in the "trigger" mixture with a filament transformer. The outside temperature of the lined crucible reached a miximum temperature of 324° C. after 6.5 minutes indicating the reaction took place. The resulting alloy measured 5 cm in diameter and 0.6 cm thick and was well separated from the $CaF_2$ slag.

EXAMPLE II

A mixture of 117 g of $TbF_3$, 320 g $DyF_3$ and 435 g. of $FeF_3$ was blended with 388 g of granular calcium metal which corresponds to the stoichiometric amount for reduction plus 10% excess of calcium. These fluorides were also dried of residual moisture prior to use. This charge was loaded into a $CaF_2$ lined steel crucible exactly the same as in Example #1. In this experiment 20 g of $FeF_3$ and 20 g of calcium metal was used as the trigger mixture. The reaction was initiated as in Example #1. Eight minutes after firing, the outside of the crucible reached a maximum temperature of 364° C. The resulting alloy of $Tb_{0.27}Dy_{0.73}Fe_{1.9}$ weighed 480 grams and was ~1 cm thick. This weight corresponds to an alloy yield of 89%.

EXAMPLE III

A mixture of 80.5 g $NdF_3$, 158 g $FeF_3$, 2.2 g boron was blended with 119 g of granular calcium metal which corresponds to the stoichiometric amount for reduction plus a 10% excess of calcium. This charge was loaded inside a $CaF_2$ lined steel crucible as in Examples I and II. The reaction was initiated by heating the trigger mixture with a hot iron filament as in the two previous examples. The outside of the crucible reached a maximum temperature of 400° C. after six minutes. The resulting alloy weightd 110 g, measured ~0.6 cm in thickness and was well separated from the $CaF_2$ slag.

EXAMPLE IV

A mixture of 147 g $TbF_3$, 401 g $DyF_3$, and 545 g of $FeF_3$ was blended with 486 g of granular calcium which corresponds to the stoichiometric amount of calcium for the reduction of the anhydrous fluorides plus a 10% excess. The charge was loaded inside a cavity in a copper forging which measured 10 cm in diameter and 35 cm deep. The outside of the forging measured 21 cm diameter and 39 cm long. A "trigger" mixture consisting of 20 g of $FeF_3$ and 20 g of calcium was placed on top of the charge. A coiled iron filament was embedded into the trigger mixture. One end of the filament was attached to the bottom of a water-cooled stainless steel head assembly and the other end attached to an insulated iron rod extending through the head assembly attached to an automotive spark plug which served as an electrical feedthrough. The underside of the head assembly contained an "O" ring seal. A thermocouple was embedded in the side wall of the forging 27 cm from the top, which corresponded to the bottom of the charge cavity. The reaction was initiated by resistively heating the iron filament embedded in the trigger mixture with a filament transformer. Upon firing the charge, the copper forging (crucible) increased in temperature and reached a maximum of 104° C. after two minutes. Excellent separation of the $CaF_2$ slag phase and $Tb_{0.27}Dy_{0.73}Fe_{1.9}$ alloy phase was achieved. The alloy weighed 693 g which corresponds to a yield of 94%.

Analysis of the as formed alloy by titrametric and spectrophotometric techniques showed that the alloy contained 562 ppm C, 60 ppm $O_2$, 12 ppm $N_2$ and 79 ppm $H_2$. The alloy was found to contain 14.74 weight percent (w/o) Tb, 37.16 w/o Dy and 82.0 w/o Fe.

EXAMPLE V

A mixture of 279 g $NdF_3$, 271 g Fe, 548 g $FeF_3$, 7.5 g boron and 413 g of granular calcium was blended which corresponds to the stoichiometric amount of calcium for reduction of the anhydrous fluorides plus a 10% excess. The charge was loaded in a copper forging and firing exactly the same as was the charge in Example #IV. Upon firing the charge, the copper forging (crucible) increased in temperature and reached a maximum of 132° C. after two minutes. Excellent separation of the $Nd_2Fe_{14}B$ alloy phase and the $CaF_2$ slag phase was achieved. The alloy weighed 752 g which corresponds to a 87% yield.

Upon analysis as described in Example IV the alloy was found to contained 330 ppm C, 18–120 ppm $N_2$, 38 ppm $O_2$ and 15 ppm $H_2$. The alloy was 17.36 w/o in Nd 82.30 w/o Fe and 1.24 w/o. This corresponds to a theoretical composition of 26.73 w/o Nd, 72.43 w/o Fe and 0.83 w/o B.

EXAMPLE VI

A mixture exactly the same as described in Example IV was fired inside a thick wall iron crucible instead of a copper forging. The cavity inside the iron crucible also measured 10 cm in diameter and 35 cm long. The outside of the iron crucible was 25 cm in diameter and 50 cm long. After firing the charge the iron crucible reached 110° C. after 2.5 minutes. The $CaF_2$ slag phase was well separated from the $Tb_{0.27}Dy_{0.73}Fe_{1.9}$ alloy phase and an alloy yield of 95% was obtained.

Upon analysis, the alloy was found to contained 97 ppm $O_2$, 130 ppm $N_2$, 40 ppm $H_2$ and 500 ppm C. The alloy was 14.5 w/o Tb, 35.5 w/o Dy and 50/5 w/o Fe.

As can be seen from the preceeding description and Examples, the method of the invention provides an effective, rapid and relatively inexpensive method for the production of quantities of rare earth-iron alloys.

The embodiments of this invention in which an exclusive property or privilege is claimed are defined as follows:

1. An improved method for preparihg rare earth-iron alloys comprising:

mixing at least one rare earth fluoride with an iron fluoride to form a mixture, adding calcium metal to the mixture to form a reaction mixture, the amount of calcium being at least a stoichiometric amount necessary to completely reduce the fluorides to the metal, heating the reaction mixture in a sealed container under reducing conditions to a temperature sufficient to react the fluorides in the mixture with the calcium metal to form a metal alloy and a calcium fluoride slag, and separating the metal alloy for the slag thereby forming the rare earth-iron alloy.

2. The method of claim 1 wherein the iron fluoride is one or more members selected from the group consisting of ferric fluoride and ferrous fluoride.

3. The method of claim 2 wherein elemental iron is substituted for some of the iron fluoride.

4. The method of claim 3 wherein the sealed reduction container is selected from the group of a metal crucible lined with refractory material, a water-cooled copper reduction bomb, and a thick-walled iron crucible.

5. The method of claim 4 wherein the reaction mixture contains a 10% excess of the stoichiometric amount of calcium necessary to completely reduce the fluorides.

6. The method of claim 5 including the additional step of melting the metal alloy after separating the alloy from the slag to remove residual calcium fluoride and calcium metal from the alloy.

7. The method of claim 6 wherein additional purified metal is added to the alloy during melting to adjust the ratio of metals in the alloy.

8. The method of claim 7 wherein the rare-earth fluoride is selected from the group consisting of lanthanum, praseodymium, erbium, dysprosium, neodymium, terbium, holmium, and samarium.

9. The method of claim 8 wherein the rare earth fluoride is selected from the group consisting of lanthanum, praseodymium, erbium, dysprosium, and neodymium and the mixture contains boron.

10. The method of claim 8 wherein the rare earth fluoride is two or more selected from the group consisting of terbium, dysprosium, holmium, and samarium.

11. The method of claim 1 wherein the reaction temperature is sufficient for the reduction reaction to go to completion, to consolidate the reduced metal into the alloy and to separate the alloy as a mass from the slag.

12. The method of claim 11 wherein the reaction temperature is at least 1600° C.

13. The method of claim 8 wherein the mixture contains one or more alloying metals.

* * * * *